United States Patent [19]

Soper

[11] Patent Number: 4,885,875

[45] Date of Patent: Dec. 12, 1989

[54] LENS EDGING MACHINE AND METHOD

[76] Inventor: Peter H. Soper, 241 Bilton Road, Rugby, Warwickshire, England

[21] Appl. No.: 139,875

[22] Filed: Dec. 30, 1987

[30] Foreign Application Priority Data

Jan. 5, 1987 [GB] United Kingdom ..... 8700066

[51] Int. Cl.[4] ..... B24B 9/14

[52] U.S. Cl. ..... 51/284 E; 51/101 LG; 51/105 LG; 51/106 LG

[58] Field of Search ..... 51/101 LG, 284 E, 284 R, 51/105 LG, 106 LG

[56] References Cited

U.S. PATENT DOCUMENTS 3,520,091 7/1970 Raphael ..... 51/101 LG
4,003,165 1/1977 Saun ..... 51/101 LG

FOREIGN PATENT DOCUMENTS 2068797 8/1981 United Kingdom ..... 51/284 E

*Primary Examiner*—Robert P. Olszewski
*Assistant Examiner*—Jack Lavinder
*Attorney, Agent, or Firm*—Banner, Birch, McKie & Beckett

[57] ABSTRACT

A method of grinding the periphery of an opthalmic lens blank (B) comprising rotating the blank periphery against a grinding wheel (38, 40, 42) and simultaneously rotating a template (110) disposed coaxially relative to the blank and having the desired peripheral configuration of the finished lens. The template is positioned for cooperation with a follower (114) such that the template causes rotation of the follower when the template and follower are caused to engage one another in response to removal of material (MR) from the blank. Each period of time during which the follower is set into rotation by the template is determined and compared to a predetermined period corresponding to one revolution of the blank. The grinding operation is caused to continue if rotation of the follower during the predetermined period stops and the timed period is re-set to zero, upon recommencement of follower rotation, for comparison with the predetermined period until the timed period corresponds to the predetermined period whereupon the grinding operation is ceased.

9 Claims, 10 Drawing Sheets

LENS EDGING MACHINE AND METHOD

This invention relates to an abrading apparatus and method for edge grinding the periphery of an article such as a lens blank to a predetermined peripheral configuration. The invention is particularly, although not exclusively, concerned with the edge grinding of opthalmic lenses.

The present invention seeks to improve the automatic peripheral grinding of an article such as an opthalmic lens particularly in relation to the manner in which signalling "down to size" of the lens blank is achieved and in relation to the transfer of the lens from one grinding station to another automatically during the performance of a multiple grinding operation from a single set-up of the article in the machine. In the present invention, a compact relatively simple machine on which it is easy to set-up for the grinding operation achieves good accuracy, edge appearance, reliability and longevity.

One aspect of the invention provides a method of grinding the periphery of an article, such as an opthalmic lens blank, which method comprises rotating the blank periphery against a grinding wheel and simultaneously rotating a template disposed coaxially relative to the blank and having the desired peripheral configuration of the finished lens, said template being positioned for cooperation with a follower such that the template causes rotation of the follower when the template and follower are caused to engage one another in response to removal of material from the blank, determining each period of time during which the follower is set into rotation by said template and comparing that period with a predetermined period corresponding to one revolution of the blank, causing the grinding operation to continue if rotation of the follower during said predetermined period stops and re-setting to zero, upon recommencement of follower rotation, the period timed for comparison with the predetermined period until said time period corresponds to said predetermined period, whereupon the grinding operation is ceased.

Another aspect of the invention provides apparatus for grinding the periphery of an article, such as an opthalmic lens blank, which apparatus comprises means for holding and rotating simultaneously in coaxial relationship, a blank and a template, having the desired peripheral configuration of the finished lens, a rotatable grinding wheel disposed so that movement of said holding means relative to the grinding wheel can bring the blank into and out of engagement with the grinding wheel, follower means mounted for cooperation with said template such that the template causes rotation of the follower during grinding when the template and follower engage one another in response to removal of material from the blank, signalling means for determining each period of time during which the follower is set into rotation and computing means for comparing that period with a predetermined period corresponding to one revolution of the blank, the arrangement being such that grinding is continued until said comparison period is equal to said predetermined period whereupon grinding is ceased.

An apparatus and method for edge grinding the periphery of an opthalmic lens to a predetermined configuration embodying the invention will now be described, by way of example, with reference to the accompanying drawings, in which.

Figure 2:
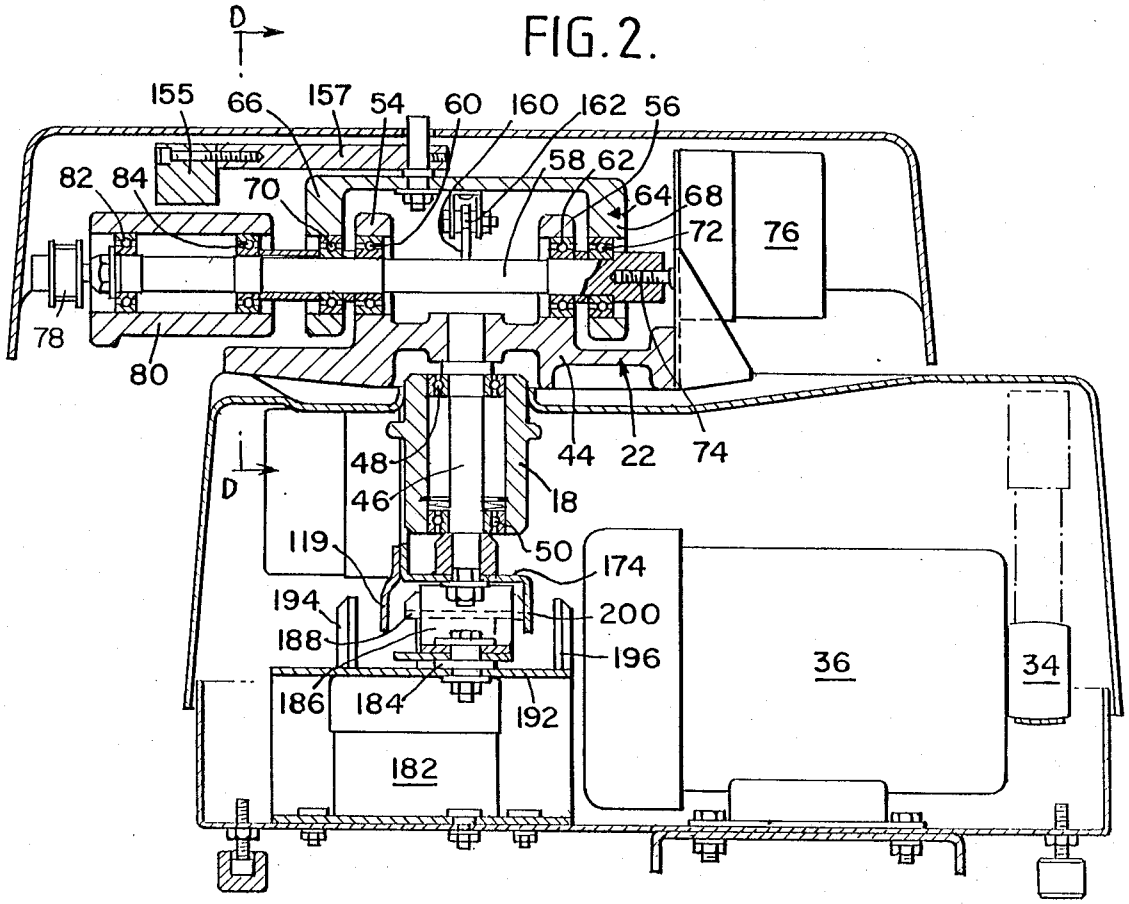
FIG. 2 is a cross-sectional view taken on line A—A in FIG. 1.
Figure 3:
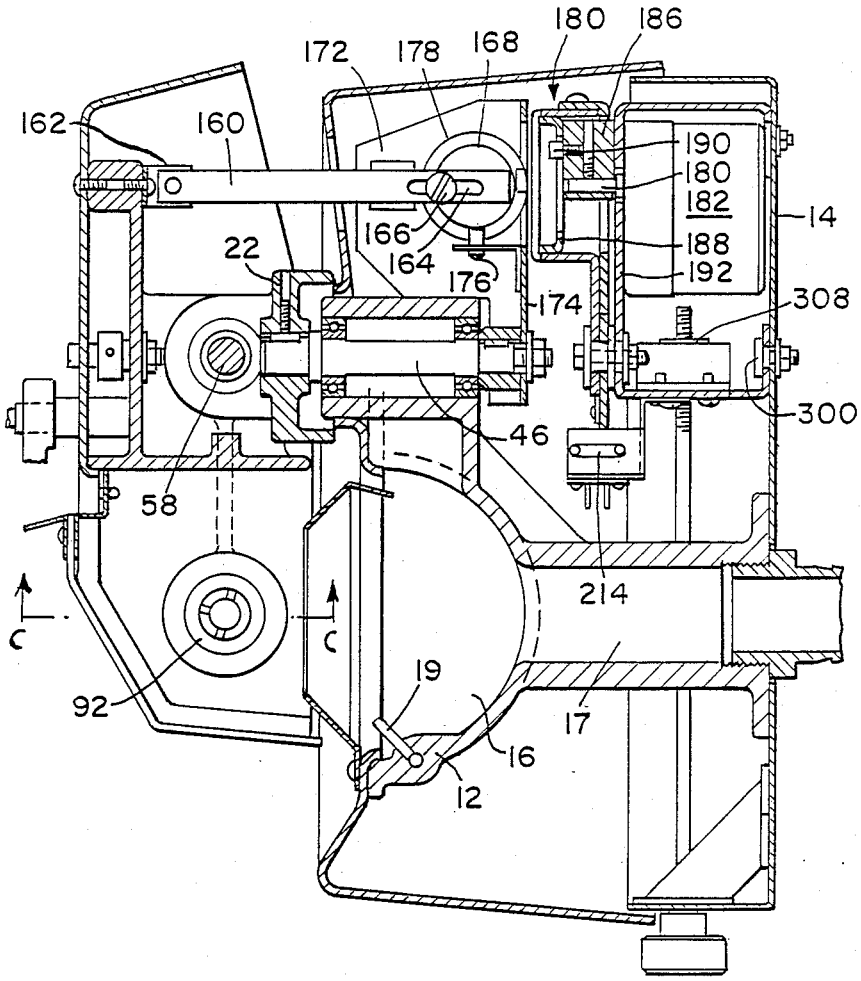
FIG. 3 is a cross-sectional view taken on the line B—B in FIG. 1.
Figure 4:
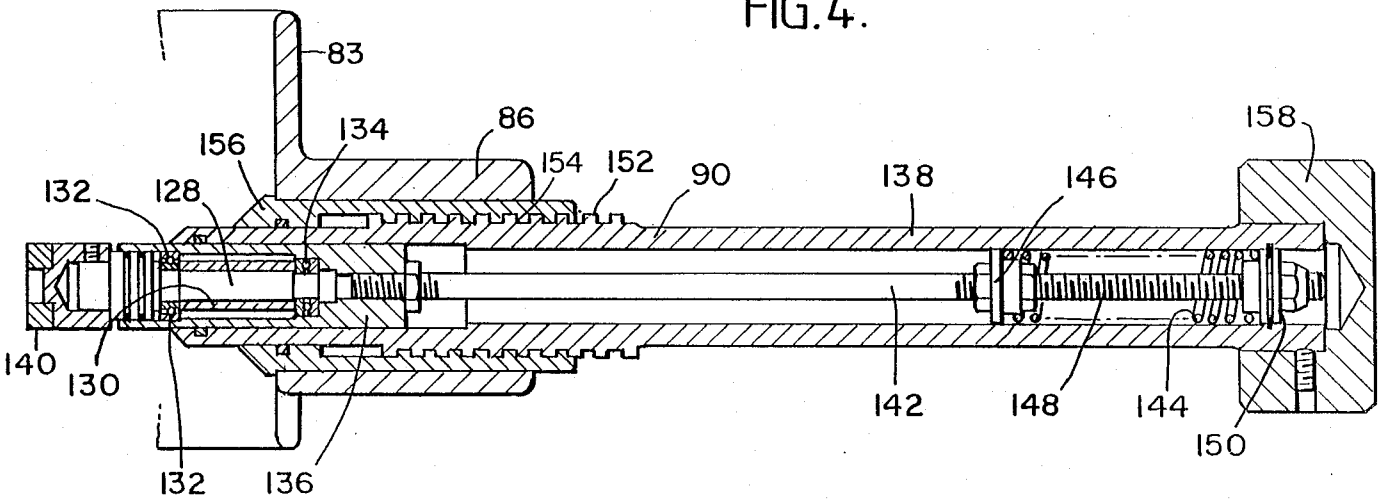
FIG. 4 is a cross-sectional view of a first right hand lens holding shaft, assembly taken on the line C—C in FIG. 3.
Figure 4A:
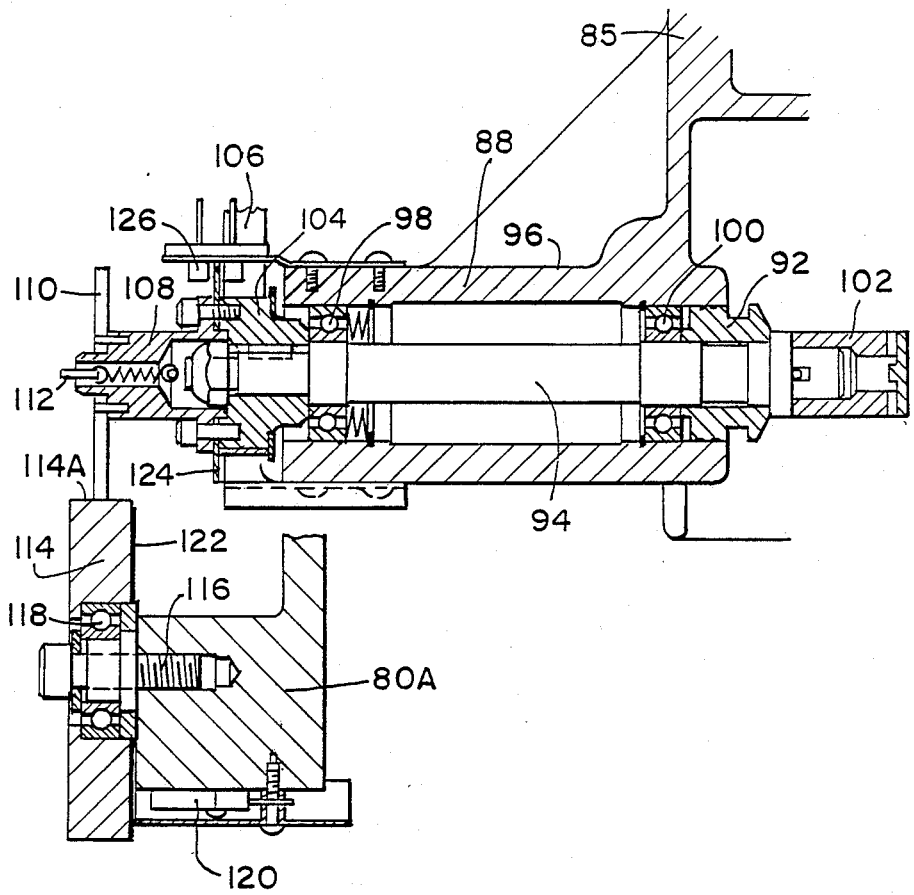
Figure 5:
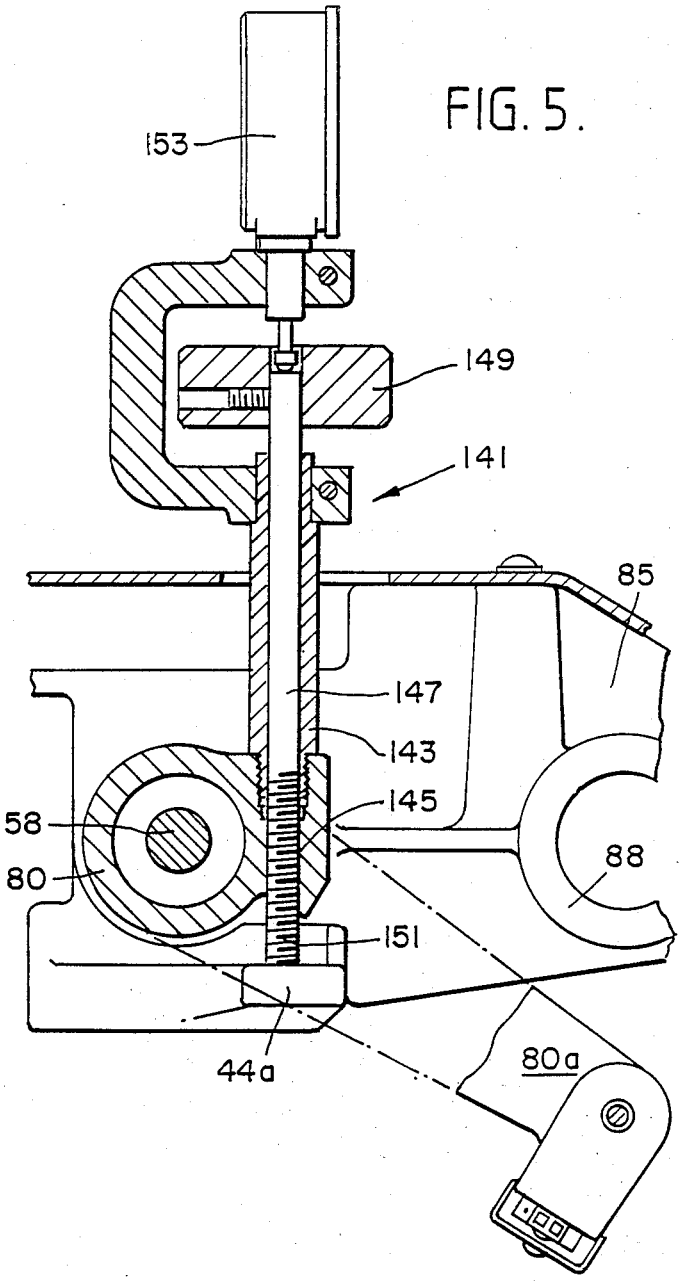
Figure 6:
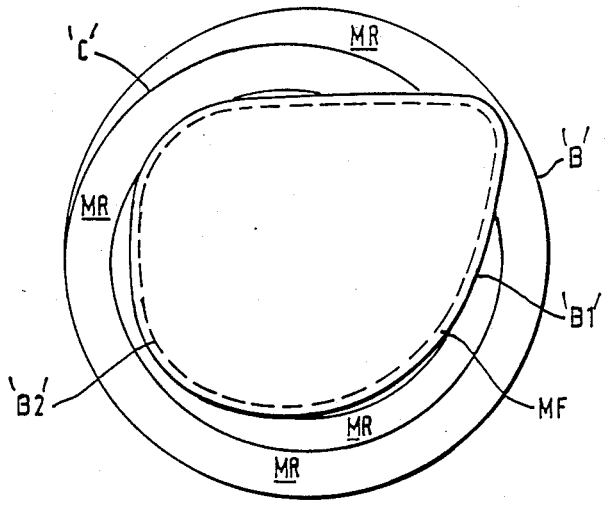
Figure 7:
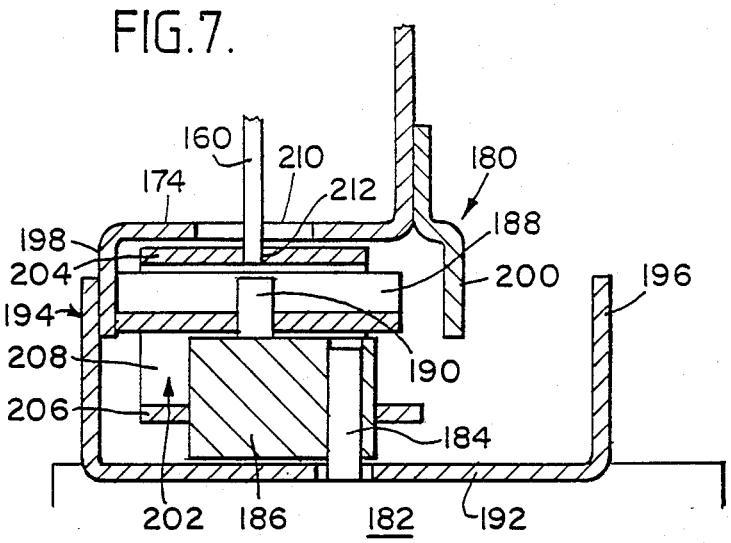
Figure 8:
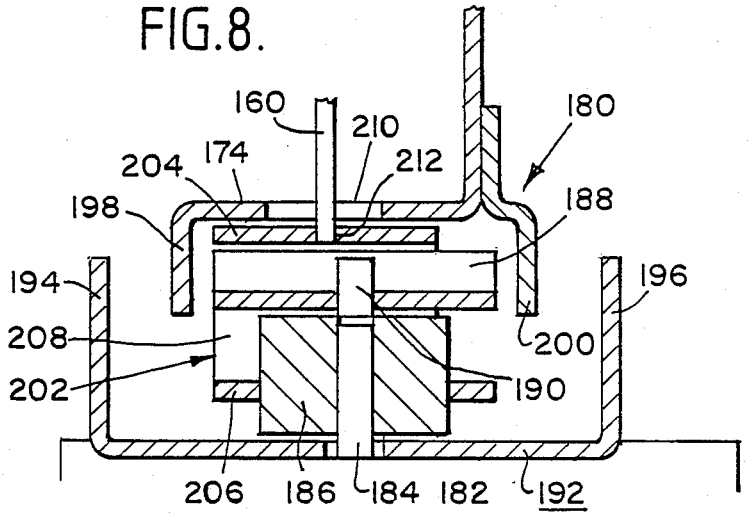
Figure 9:
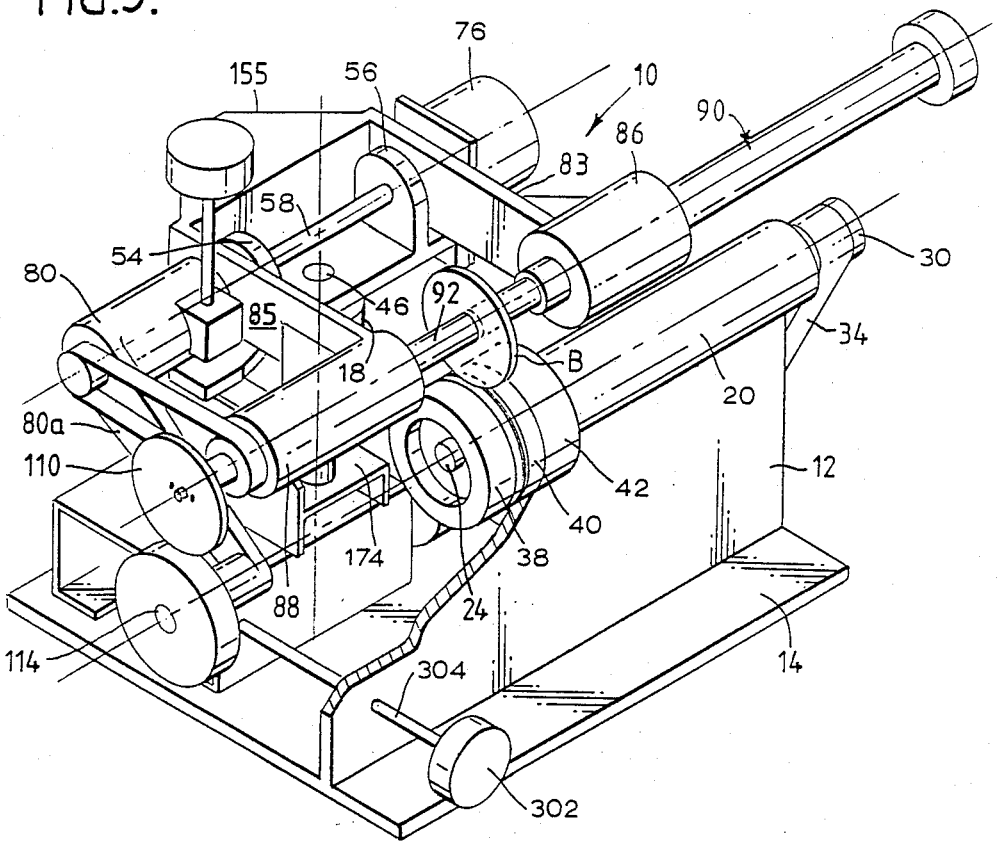
Figure 10:
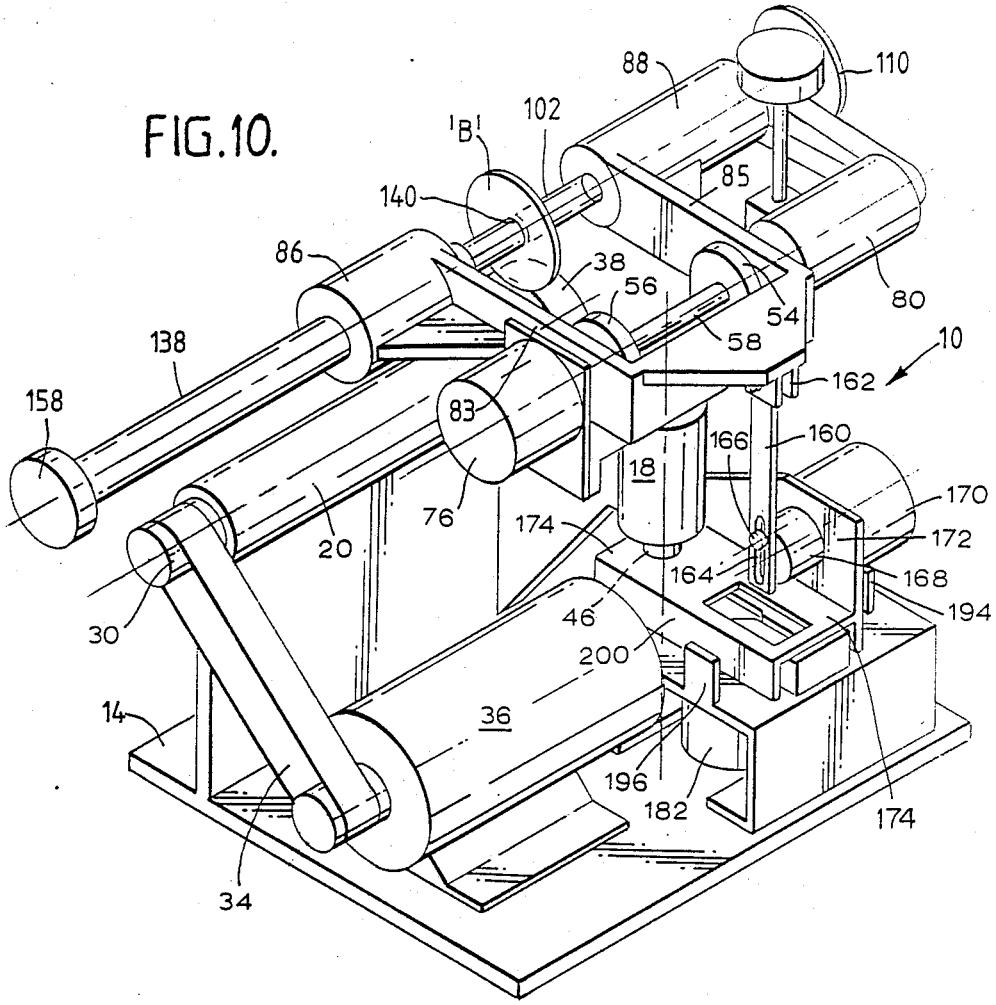

FIG. 4*a* is a cross-sectional view of a second left hand cooperating lens holding shaft assembly taken along the line C—C in FIG. 3;

FIG. 5 is a cross-sectional view taken on the line D—D in FIG. 2;

FIG. 6 is a schematic view of a lens blank illustrating grinding cut lines to achieve oversized and final lens configurations;

FIG. 7 is a schematic view of a mechanism for controlling translatory movement of the lens relative to the grinding wheels with the lens carriage held to maintain the lens blank in locked position relative to one grinding wheel;

FIG. 8 is a further schematic view similar to FIG. 7 with the lens carriage held to allow limited translatory movement or 'float' of the lens blank relative to a second grinding wheel;

FIG. 9 is a perspective view of the lens edge grinding apparatus as seen from the front and to one side in which the casing of the apparatus is partially broken away; and FIG. 10 is a perspective view of the lens edge grinding apparatus as seen from the rear and from an opposite side.

Referring to the drawings, an opthalmic lens edge grinding machine 10 comprises a main fixed casting 12 which is seated on the base frame 14 of the machine. Fixed casting 12 has a well 16 adapted to accommodate the grinding wheels of the machine and from which two tubular bodies 18 and 20 extend. Tubular body 18 extends vertically of the machine at one end of the well and carries a pivotal shaft for a carriage support structure 22. Tubular body 20 extends horizontally from one side wall of the well perpendicular to the tubular body 18. A grinding wheel drive spindle 24 is journalled in the tubular body 20 by rolling thrust bearings 26 and 28 and is furnished with an idler pulley 30 remote from the grinding wheel well.

Rotational drive is transmitted to spindle 24 by a drive belt 34 entrained about an idler pulley 30 and a drive pulley 34 of main drive motor 36 fixed to base frame 14. A set of three coaxial grinding wheels 38, 40 and 42 is clamped together at the free end of drive spindle 24 extending into the well 16 so that the grinding wheels rotate together in use, partially within the well.

The well 16 communicates with a sump (not shown) by means of an upstanding fluid passageway 17 so that coolant, directed onto the grinding wheels from nozzles 19 (FIG. 3) can be recirculated.

The carriage support structure 22 (FIG. 2) comprises a horizontal cross piece 44 which is mounted atop a vertical pivot shaft 46 journalled in rolling bearings 48, 50 respectively within the vertical tubular body 18. The lowermost end of the vertical pivot shaft is connected for rotation by a drive motor 182 of a carriage transfer operating mechanism 180 as will be described more fully hereinafter.

Cross piece 44 carries a pair of upstanding integral lugs 54 and 56 spaced apart one on either side of the pivot shaft 46 through which horizontal lens drive shaft 58 extends. Lens drive shaft 58 is rotatably journalled in lugs 54 and 56 by rolling bearings 60 and 62 respectively. A main lens holding carriage 64 includes integral downwardly extending arms 66 and 68 which include through bores housing rolling bearings 70 and 72 coaxial with bearings 60 and 62 located in the cross piece lugs and through which lens drive shaft 58 also extends. A drive spindle 74 of lens drive shaft motor 76, supported on an extension of cross piece 44 is inserted into one end of the drive shaft 58. Rotational drive is transmitted by the shaft 58 to a drive pulley 78 carried by the opposite end of drive shaft 58. Intermediate, the drive pulley 78 and lens holding carriage 64, drive shaft 58 passes through casting boss 80 in which the drive shaft is journalled by spaced rolling bearings 82 and 84. The casting boss 80 includes a downward extension **80*a* (FIGS. 4*a* and 5**) which supports a lens template roller follower assembly as will be described later.

The main lens holding carriage 64 further comprises a pair of spaced horizontal arms 83 and 85 extending perpendicularly from the downward lens drive shaft support arms 66 and 68 so that they overlie the grinding well 16. Referring more particularly to FIGS. 4 and **4*a* horizontal arm 83 is formed with an integral tubular part 86 extending in one direction away from the grinding wheel set and horizontal arm 85 also is formed with an integral tubular part 88 extending in the opposite direction away from the grinding wheel set. Tubular part 86 carries lens holding shaft assembly 90 and tubular part 88 carries lens holding shaft assembly 92 in coaxial relationship, both lens holding shaft assemblies having axes parallel to the lens drive shaft 58 and to the grinding wheel drive spindle 24**.

It will be appreciated from the description thus far that the whole main lens holding carriage 64 including the lens holding shaft assemblies 90 and 92 together with the lens drive shaft 58 and the carriage support structure 22 are rotatable together about the vertical pivot shaft 46. Moreover, the lens holding carriage 64 is pivotal about the carriage support structure 22 whereby the lens holding shaft assemblies 90 and 92 are movable arcuately together towards and away from the grinding wheel set.

The lens holding shaft assemblies 90 and 92 are adapted to clamp and rotationally hold a lens blank between them in the proximity of the grinding wheel set. To this end, the lens holding shaft assembly 92 shown in FIG. **4*a* comprises a driven shaft 94 journalled in the tubular part 88 within a sleeve 96 by spaced roller bearings 98 and 100. At one of its ends, shaft 94 is provided with a lens engaging nose 1 externally of the sleeve 96 and at its opposite end shaft 94 has a pulley assembly 104 by which drive is transmitted to shaft 94 from the lens drive shaft 58. For this purpose, an endless belt 103 is entrained about drive pulley 78 of drive shaft 58 and drive pulley assembly 104. A lens template carrier 108 is releasably secured to pulley assembly 104 which, in use, holds at its free end a lens template 110 by means of a spring loaded clip 112. The lens template is mounted for cooperation with a roller follower and will cause rotation of the roller follower when the lens template engages the peripheral edge 114*a* of the follower. The roller follower is freely rotatable about a stub shaft 116 upon a rolling bearing 118 carried by the stub shaft. The stub shaft is keyed into and supported by the downward extension 80*a* of casting boss 80. An optical sensor device 120 is secured to the underface of extension 80*a* and is located so as to 'read' an encoder disc 122 carried on that face of the roller follower which is adjacent the extension 80*a*. Puller assembly 104 carries a slotted disc 124 which is arranged to cooperate with a further optical sensor device 126 connected to tubular part 88**.

Referring now to FIG. 4, the lens holding shaft assembly 90 comprises a rotatable spindle 128 mounted within a bush 130 and journalled at spaced locations by a radial rolling bearing 132 and an axial rolling bearing 134 mounted together with the bush 130 within a sleeve 136. Sleeve 136 is mounted for limited axial sliding movement at one end of a hollow shaft 138. At its free end the sleeve 136 extends from one end of the hollow shaft 138 and terminates in a lens engaging nose 140. A push rod 142 extends from the opposite end of the sleeve through the hollow shaft 138 and bears against a pre-compressed helical compression spring 144 by means of a thrust washer 146 carried by the push rod. The compression spring is mounted coaxially about the threaded part 148 of the push rod 142 restrained by an end stop 150 at the end of the hollow shaft remote from nose 140 into which the push rod can slide when the spring is further compressed during axial movement of the sleeve 136 to retract the lens engaging nose 140. The hollow shaft includes an externally screw-threaded portion 152 which cooperates with an internally screw-threaded portion 154 of a screw-threaded cylinder 156 fixed within the tubular part 86 of the lens holding carriage 64.

When both lens holding shaft assemblies are present in their respective tubular parts of the lens holding carriage, lens engaging nose 140 is juxtaposed lens engaging nose 102 and can be moved towards and away from nose 102 by rotating the hollow shaft 138 by means of adjusting knob 158 to move the hollow shaft, sleeve 136 and spindle 128 axially together. When the lens engaging noses are brought together, the nose 140 can be axially displaced against the force of the compression spring 144 and a lens blank 'B' to be ground can then be clamped by the restorative force of the compression spring with the opposite faces of the lens blank held between the noses 102, 140.

In order to grind a lens blank 'B', the blank to be ground is loaded between the lens engaging noses 102 and 140 of the lens holding shaft assemblies 90, 92 respectively as referred to above and an appropriate lens template 110 having the peripheral profile of the desired finished lens is secured onto the template carrier 108. Thereafter, the lens template is caused to engage the peripheral edge 114A of the roller follower 114 by pivoting the main lens holding carriage 64 about the lens drive shaft 58. Downward movement of the lens holding carriage into engagement with the roller follower is governed by the rate of removal of material from the lens blank in engagement with one of the grinding wheels. In the arrangement shown, grinding wheel 38 may be a roughing wheel for taking coarse cuts into the lens blank periphery; grinding wheel 42 a finishing wheel for taking fine cuts into the lens blank periphery and grinding wheel 40 a bevelling wheel for creating a continuous peripheral bevel around the lens edge.

A template follower adjusting assembly 141 (FIG. 5) includes an upright sleeve 143 having one end projecting above the lens holding carriage and its other end in communication with a screw threaded bore 145 through casting boss 80 offset and perpendicular to the axis of the lens drive shaft 58. The sleeve 143 receives a rotatable rod 147 having an upper head 149 and a lower screw-threaded end 151 which cooperates with the screw-threaded bore 145 and bears upon an extension 44*a* of carriage support cross piece 44. Manipulation of the head 149 to rotate the rod causes substantial vertical movement of the casting boss 80 about the lens drive shaft 58 which in turn shifts the axis of the template follower 114 substantially vertically via casting extension 80*a*. A gauge 153 is provided to indicate the position of the template follower relative to the grinding wheels and hence the size differential between the lens and the template.

A counterweight 155 is carried by arm 157 fixed by a rotatable fastener 159 to the lens holding carriage 64 in order to balance part of the mass of the carriage about lens device shaft 58. Rotation of fastener 159 through 90 degrees varies the movement arm of counterweight 155 and so varies that part of the carriage weight which imposes the grinding force upon the lens blank.

In a typical lens blank grinding operation, the main drive motor is activated to rotate the grinding wheel set and the blank will be engaged with roughing wheel 38. Referring now also to FIG. 6, the lens blank 'B' which initially has a substantially circular profile has its peripheral edge ground with grinding continuing along spiral 'cut' line 'C' until signals taken from the roller follower indicate that an over-size blank profile has been obtained all around the blank periphery as shown by oversize blank 'B1' resulting from the removal of material 'MR'. The encoder label 122 is 'read' by the sensor 120 so that if the encoder signals that rotation of the roller continues for a period of time which is known to equal one completed revolution of the lens, as transmitted to the roller follower by the template, then a completed periphery has been established and the next stage in the cycle of operations is signalled. If however, rotation of the roller follower stops, then the encoder presents that information and the timed period, by which one revolution is compared is reset to zero and counting of the timed period is restarted every time that rotation of the roller follower starts until a timed period equal to one revolution is completed. By virtue of the signalling device provided by disc 122 and sensor 120 the switching position and stop position of the lens holding shaft assemblies are as exactly coincident as the practical physical limitations of the mechanical design will allow. Once an oversize profile 'B1' has been achieved, the blank automatically is caused to lift-off grinding wheel 38 and transfers to finishing wheel 42 on which it descends and a similar procedure to that described above takes place by removal of material 'MF' to obtain the final profile shape 'B2'. The blank 'B2' then automatically lifts off finishing wheel 42 and transfers to a bevelling wheel 40 on which it descends by which a bevelled edge is ground onto the periphery of the blank 'B2', normally in a single revolution, thereby to produce a completed lens. The lens is caused automatically to lift off the bevelling wheel 40 and the machine is then de-activated.

Figure 1:
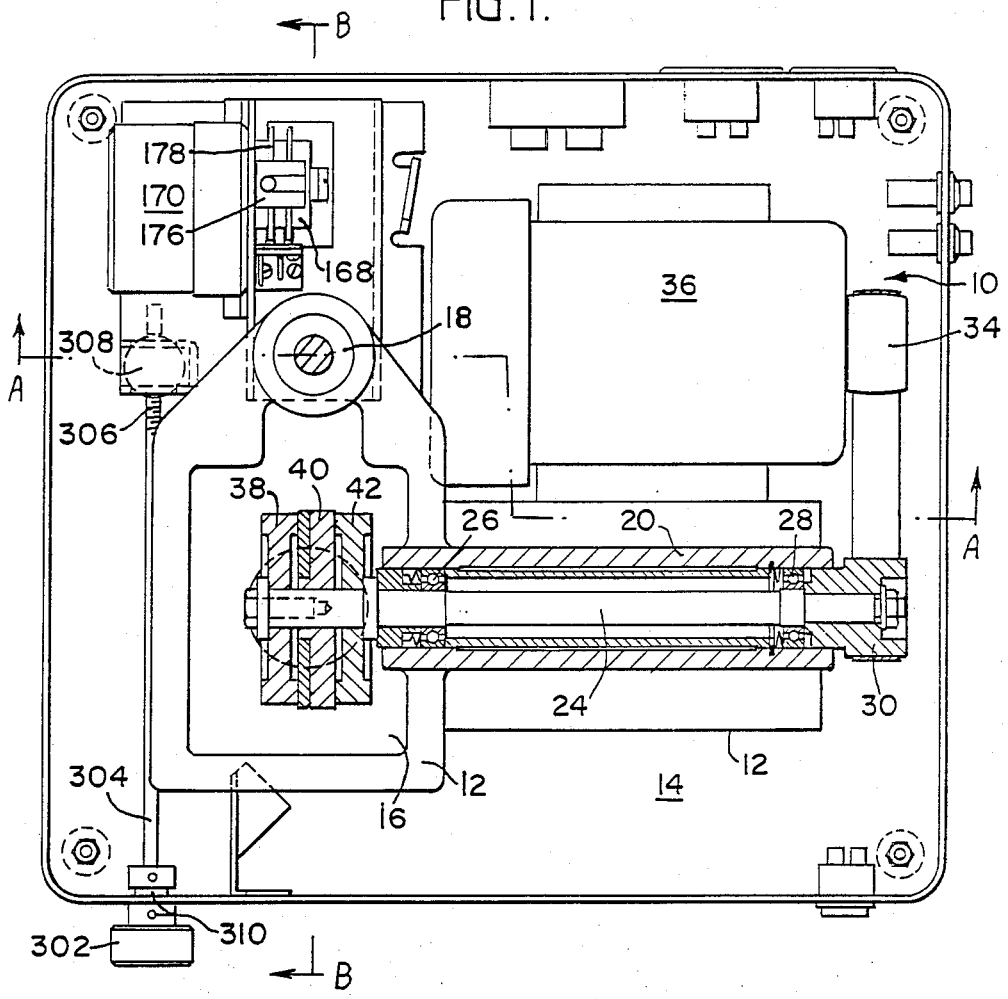
FIG. 1 is a plan view of the apparatus in partial cross-section.

The automatic lift-off, transfer and re-engagement of the lens blank is achieved by a transfer mechanism described below with particular reference to FIGS. 7 and 8. In order to provide for pivotal movement of the lens holding carriage 64 about the lens drive shaft 58 to achieve engagement and disengagement of the lens blank relative to the grinding wheel set 38–42, an elongate lifting rod 160 is pivotally connected by means of pivot assembly 162 centrally of the lens holding carriage remote from the lens holding shaft assemblies 90 and 92. Adjacent its lower end the lifting rod is formed with an elongate slot 164 through which fastener 166 extends and slidably connects the lifting rod to an eccentric boss 168 driven by electric motor 170. Motor 170 is mounted on a vertical flange 172 of a pivot shaft actuating arm 174 which extends horizontally and is connected to the lowermost end of the pivot shaft 46. The electric motor 170 is activated via an optical sensing switch which comprises an optical sensor device 176 which 'reads' a pair of slotted discs 178 carried by the eccentric boss in order to control rotation of the eccentric boss and thereby movement of the slotted lifting rod 160 (FIG. 1).

A carriage transfer operating mechanism 180 is disposed below the pivot shaft actuating arm 174 and is adapted to cooperate with the lifting rod for lens holding carriage transfer which produces a translatory movement of the lens blank relative to the grinding wheel axes resulting from pivotal movement of the lens carriage 64 about pivot shaft 46.

Carriage transfer operating mechanism comprises an electric drive motor 182 secured to the machine frame 14 which has an upstanding drive shaft 184 connected to an eccentric boss 186. A sliding stop 188 is mounted atop the eccentric boss by means of drive pin 190 which extends axially of the eccentric boss and so is axially offset from the drive shaft 184. Drive shaft 184 extends through a bracket 192 disposed between the drive motor 182 and the eccentric boss 186. The bracket 192 is formed with upstanding spaced flanges 194, 196 respectively, which provide a pair of fixed stops of the transfer mechanism. The sliding stop 188 is accommodated with clearance between spaced flanges 198 and 200 depending downwardly from the pivot shaft actuating arm 174. A carriage operating lever 202 includes a top arm 204 disposed intermediate the actuating arm 174 and the sliding stop, a bottom arm 206 cooperating with the eccentric boss 186 and a connecting web 208 interconnecting the top and bottom arms. Pivot shaft actuating arm 174 includes an opening 210 through which the slotted end of the lifting rod can travel and engage within a slot 212 formed in the top arm 204 of the carriage operating lever. The drive motor is controlled by an optical sensor device 214 to index the eccentric boss to any of three discrete locations (FIG. 3). Operation of the transfer mechanism will now be described in relation to a grinding operation in which a lens blank has completed a rough grind on wheel 38 and is to be transferred first to a finishing wheel 40 and thereafter to bevelling wheel 42. If it is assumed that the relative position of the components shown in FIG. 7 corresponds to the rough grinding position, then transfer to the finish grinding position will be described. Upon completion of rough grinding, the motor 170 is activated in order to rotate eccentric boss 168 and cause the lifting rod to be displaced from a raised position in which its slotted end is clear of the pivot shaft actuating arm 174 to a position in which it enters slot 212 in the top arm of the carriage operating lever via opening 212 in actuating arm 174. In the position shown in FIG. 7, the lens holding carriage is held locked against rotation about pivot shaft 46 because flange 198 of the pivot shaft actuating arm 174 is held clamped between fixed stop 194 and sliding stop 188.

Downward displacement of the lifting rod causes the lens holding carriage 64 to pivot about lens drive shaft 58 and raise the lens holding shaft assemblies 90, 92 together with the lens blank 110 so that the lens blank is disengaged from the grinding wheel 38. The drive motor 182 is then signalled to activate such that the eccentric boss 186 rotates thereby moving the sliding stop to the right out of abutment with flange 198 and into abutment with the opposed flange 200. As the eccentric boss 186 continues to revolve the movement is transmitted by the carriage operating lever 202 to the lifting rod 160 and thence, to the pivot shaft operating arm 174 until flange 200 abuts the fixed stop 196 and is locked in that position by the sliding stop 188 bearing against flange 200. Movement of the pivot shaft operating arm between the fixed stops causes sufficient rotation of the pivot shaft as is necessary to translate the lens blank from its raised position above rough grinding wheel 38 to a raised position above finishing grinding wheel 42. In order to lower the lens blank onto wheel 42, the drive motor 170 is again actuated to displace the lifting rod upwards and thereby cause rotation of the lens holding carriage about the lens drive shaft in order to lower the lens blank. The lens holding carriage 64 is rotated about the pivot shaft to a position intermediate its opposite extremes of travel in order to allow the lens blank to be engaged with the bevelling wheel 40. This position is illustrated in FIG. 8 and is brought about by lowering the lifting rod into operative engagement with the carriage transfer operating mechanism as described before and signalling the motor to be indexed so that the eccentric boss 186 and the carriage operating lever 202 are brought into a position centrally between the fixed stops 194 and 196. When the lifting rod is caused to be displaced so that its slotted end is withdrawn from engagement with the carriage operating lever the lens blank is brought into engagement with the bevelling wheel and grinding commences. During the bevelling process the peripheral edge of the lens is allowed to translate or 'float' relative to the bevelling wheel so that the bevelled edge is formed around the lens periphery in the optimum location having regard to the likely changes of lens thickness and curvature. This floating condition is possible because with the lifting rod 160 disengaged the pivot shaft operating arm 174 is able to rotate in either direction through a limited arc. The limitation in rotation is set by the centrally positioned sliding stop which leaves from either of its ends to the adjacent flanges of the pivot shaft operating arm 198 and 200, a gap of approximately 4 mm for travel.

The wide range of lens sizes and prescriptions required in practise, brings about a considerable variation of the lens edge position across the faces of the grinding wheels when comparing one lens with another. In order to allow the transfer mechanism 180 to position this wide range of lens blanks satisfactorily, the whole transfer mechanism is built so that it can be pivoted about a pin 300 fixed in base frame 14 and rotatably engaging bracket 192. Pin 300 is co-axial with pivot shaft 46. Manual rotation of knob 302 connected to rod 304, which is threaded at 306 and cooperates with nut 308, causes a translation of nut 308 relative to the thread. As nut 308 is an integral part of the mechanism 180, this entire transfer mechanism is forced to turn through a small angle around pin 300, threaded rod 304 making minute accommodating angular movement in spherical bearing 310. It will be obvious that if the carriage transfer mechanism moves, then so does the holding carriage 64 and hence any lens held in the carriage is repositioned relative to the wheel set 38, 40 and 42.

Compared with known edge grinding machines, the present invention provides a machine which is smaller, lighter, less complicated, uses less power and is less expensive.

I claim:

1. A method of grinding the periphery of an article such as an opthalmic lens blank, which method comprises rotating the blank periphery against a grinding wheel and simultaneously rotating a template disposed coaxially relative to the blank and having the desired peripheral configuration of the blank, said template being positioned for cooperation with a follower such that the template causes rotation of the follower when the template and follower are caused to engage one another in response to removal of material from the blank, determining each period of time during which the follower is set into rotation by said template and comparing that period with a predetermined period corresponding to one revolution of the blank, causing the grinding operation to continue if rotation of the follower during said timed period stops due to disengagement between said template and said follower and re-starting the timed period upon recommencement of follower rotation for comparison with the predetermined period, and ceasing the grinding operation when said timed period is equal to said predetermined period.

2. A method according to claim 1, wherein translatory movement of the blank relative to at least two coaxial grinding wheels is controlled by the steps of bringing blank holding means into a position relative to one of said grinding wheels so that grinding of the blank periphery can proceed and locking the holding means in said position against substantial translatory movement in a plane parallel to that containing the axes of the grinding wheels, performing a grinding operation on said blank until a desired peripheral configuration is obtained, raising the blank out of engagement with said one grinding wheel, unlocking the holding means from said one position and causing the holding means to effect said translatory movement of the blank from said one to another of the grinding wheels, causing the blank to be lowered into engagement with said other grinding wheel, limiting said translatory movement of the holding means so that the blank can effect a limited floating translatory movement relative to the peripheral edge of the said other grinding wheel during grinding and performing a grinding operation on said blank to produce a bevelled edge on said blank.

3. Apparatus for grinding the periphery of an article such as an opthalmic lens blank, which apparatus comprises at least one rotatable grinding wheel, means for holding and rotating simultaneously in coaxial relationship, a blank, and a template having the desired peripheral configuration of the finished lens, actuating means to move said holding means so that movement of said holding means relative to the grinding wheel can bring the blank into and out of engagement with the grinding wheel, follower means mounted for cooperation with said template such that the template causes rotation of the follower during grinding when the template and follower engage one another in response to removal of material from the blank, signalling means for determining each period of time during which the follower is set into rotation and computing means for comparing said period with a predetermined period corresponding to one revolution of the blank, said acutating means being responsive to said computing means such that grinding is continued until said timed period is equal to said predetermined period whereupon said actuating means causes movement of said holding means so that grinding is ceased.

4. Apparatus according to claim 3, wherein a plurality of said at least one grinding wheel are mounted for rotation about a common axis, said blank holding means is mounted for pivotal movement about a first axis disposed parallel to the axis of rotation of the grinding wheels and about a second axis perpendicular to said rotational axis of the grinding wheels, and further comprising means to pivot said holding means in one direction about said first axis to bring the blank into engagement with one of said grinding wheels and to lock said holding means against substantial movement about said second axis while grinding by said one grinding wheel proceeds, said actuating means further comprising means to activate said pivoting means and release said holding means so that the holding means is pivoted in a second direction about said first axis to bring the blank out of engagement with said one grinding wheel and to index said holding means about said second axis whereafter the holding means is again pivoted in said one direction about said first axis to bring the blank into engagement with said second grinding means, said locking means being positioned to allow the blank limited pivotal floating movement about said second axis during grinding by the second grinding wheel to form a bevelled peripheral edge on the blank.

5. Apparatus according to claim 4, wherein said lens blank holding means comprises a pair of coaxial lens holding shaft assemblies adapted to clamp and rotationally hold a lens blank between them in the proximity of said grinding wheel assembly, both of said lens holding shaft assemblies being incorporated in a lens holding carriage which carriage is pivotally mounted upon a carriage support structure for pivotal movement about said first axis, said carriage support structure being mounted on an upstanding pivot shaft for pivotal movement about said second axis.

6. Apparatus according to claim 5, wherein one of said lens holding shaft assemblies includes carrier means for holding said template to cooperate with said follower, said pair of shaft assemblies being driven by a lens drive shaft rotationally mounted in said carriage support structure parallel to said pair of shaft assemblies.

7. Apparatus according to claim 6 wherein said roller follower is carried by a part of said carriage support structure which part is rotationally adjustable about said lens drive shaft for causing substantially vertical movement of said roller follower relative to said lens template carrier means.

8. Apparatus according to claim 5 wherein a carriage transfer operating mechanism carries said upstanding pivot shaft on which said carriage support structure is mounted and also is connected to said lens holding carriage, the carriage transfer operating mechanism being operable to pivot said lens holding carriage in both said directions about said first axis to bring the lens blank into and out of engagement with a grinding wheel and being operable to pivot said carriage support structure about said second axis thereby to produce a translatory movement.

9. Apparatus according to claim 8, wherein means are provided to lock said carriage transfer operating mechanism in a first position so that said carriage support structure is held fixed at one extremity of its pivotal movement thereby permitting grinding by a first grinding wheel to be effected, means being provided to lock said carriage transfer operating mechanism in a second position so that said carriage support structure is held fixed at an opposite extremity of its pivotal movement thereby permitting grinding by a second grinding wheel to be effected, and means being provided to set said carriage transfer operating mechanism in an intermediate position so that said carriage support structure is held to allow the lens blank limited pivotal floating movement in both directions about said second axis thereby permitting grinding by a third grinding wheel to be effected so as to form a bevelled peripheral edge on said lens blank.

* * * * *